United States Patent [19]

Haag et al.

[11] 4,006,947

[45] Feb. 8, 1977

[54] LINER AND INSULATION STRUCTURE FOR REFRIGERATION APPARATUS

[75] Inventors: Charles Walter Haag; Samuel Joseph Pearson, both of Evansville, Ind.

[73] Assignee: Whirlpool Corporation, Benton Harbor, Mich.

[22] Filed: Nov. 7, 1975

[21] Appl. No.: 629,874

[52] U.S. Cl. ..... 312/214; 220/9 F

[51] Int. Cl.[2] ..... F25D 17/04; B65D 25/14

[58] Field of Search ..... 312/214, 236; 220/9 F; 62/187; 52/631

[56] References Cited

UNITED STATES PATENTS

| | | | |
|---|---|---|---|
| 3,152,199 | 10/1964 | Roberts | 264/45 |
| 3,590,594 | 7/1971 | Arend | 62/187 |
| 3,910,658 | 10/1975 | Lindenschmidt | 312/214 |
| 3,913,996 | 10/1975 | Benford | 312/214 |
| 3,933,398 | 1/1976 | Haag et al. | 312/214 |

*Primary Examiner*—Casmir A. Nunberg
*Attorney, Agent, or Firm*—Wegner, Stellman, McCord, Wiles & Wood

[57] ABSTRACT

A liner and insulation structure for a refrigeration apparatus is particularly adapted for use where the bottom wall of the refrigeration apparatus cabinet defines an irregular, nonflat surface. A separate bottom liner and insulating member is formed so as to overlie the irregular cabinet bottom wall and includes an upstanding wall portion about at least a portion of its periphery. The remainder of the liner and insulation structure for the refrigeration apparatus is formed by variously cutting and folding a laminate which includes an inner sheet liner portion and an outer insulation portion so as to define an upright wall having a lower edge portion which rests on the upstanding wall portion of the bottom liner and insulating member.

16 Claims, 10 Drawing Figures

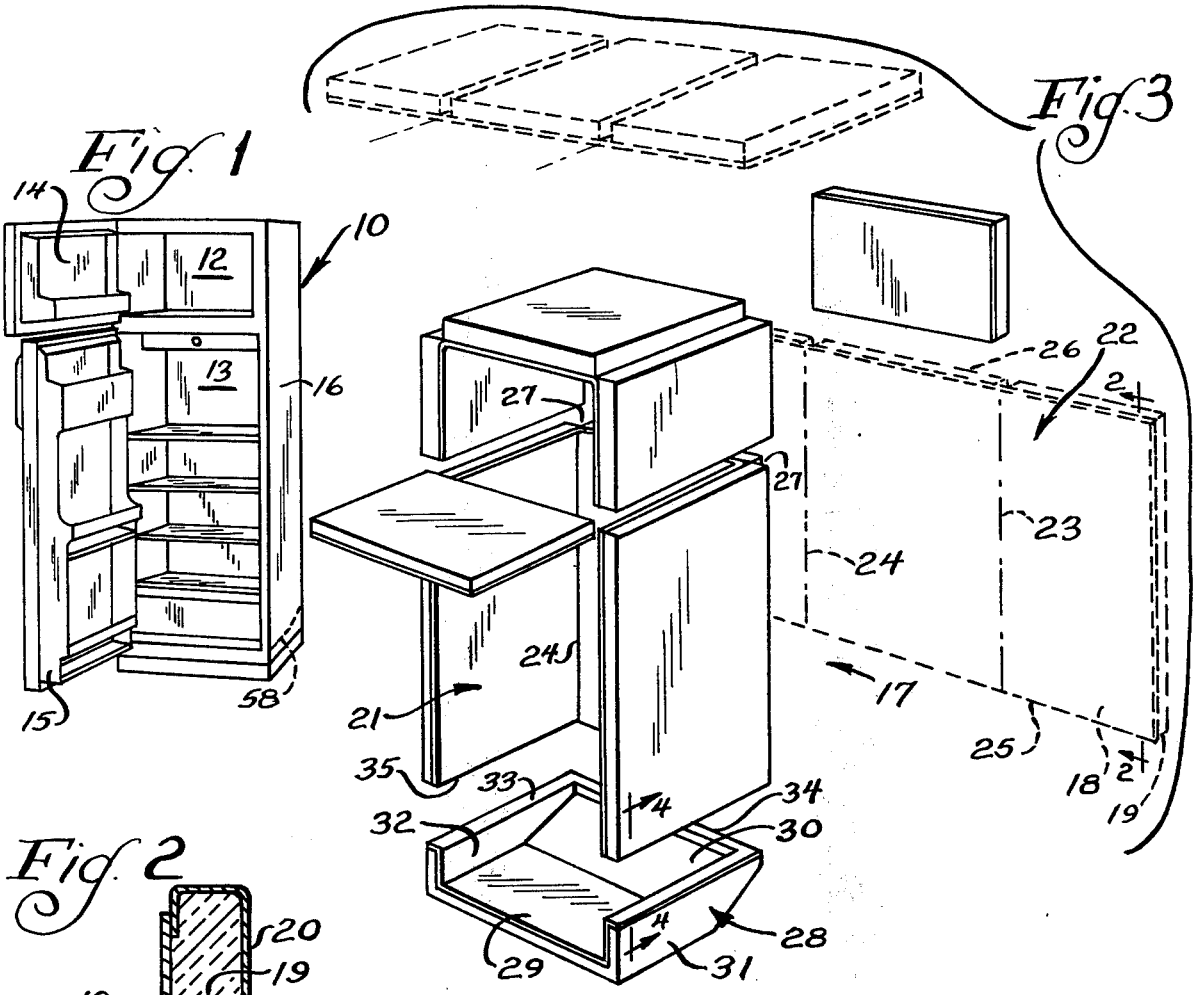
Fig. 1
Fig. 3
10
12
13
14
15
16
17
18
19
21
22
23
24
24S
25
26
27
28
29
30
31
32
33
34
35
58
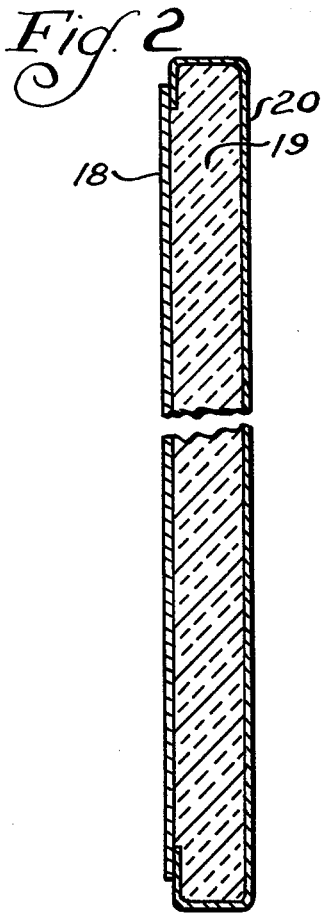
Fig. 2
18
19
20
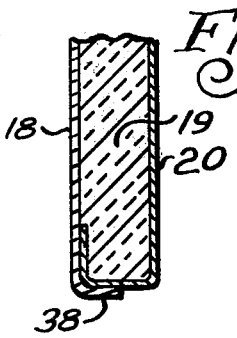
Fig. 2a
18
19
20
38
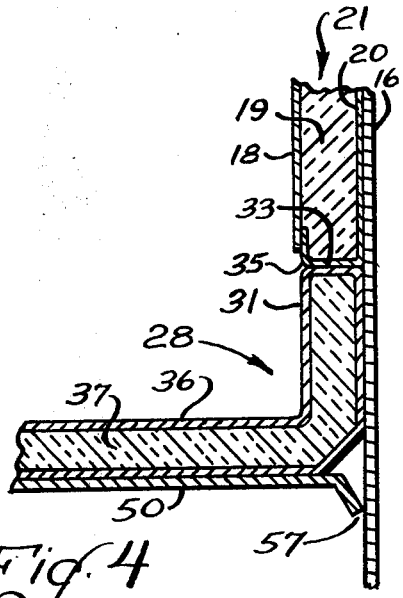
Fig. 4
16
18
19
20
21
28
31
33
35
36
37
50
57

LINER AND INSULATION STRUCTURE FOR REFRIGERATION APPARATUS

BACKGROUND OF THE INVENTION

1. Field of the Invention

This invention relates to refrigeration apparatus and in particular to a liner and insulation structure for use in refrigeration apparatus.

2. Description of the Prior Art

In U.S. Pat. No. 997,210 of Ernest Richardson, a refrigerator lining is shown to comprise a sheet metal bottom section having a top sheet metal section provided with openings for securing the sections together.

In U.S. Pat. No. 1,160,530, also issued to Ernest Richardson, a refrigerator liner is disclosed which includes a bottom portion having two upstanding sides which are flanged to support the bottom of an icebox compartment above.

In U.S. Pat. No. 3,590,594 of Raymond Arend, a refrigerator cabinet is provided with a bottom wall including an insulated pan defining the underside wall of the evaporator. The cabinet further includes a bottom wall which overlies the evaporator chamber and defines the lower wall of the refrigerated space extending substantially horizontally thereacross.

In U.S. Pat. No. 3,910,658 of Robert Lindenschmidt, assigned to the assignee of the present application, a rectangular refrigerator liner is formed by cutting and folding a laminate which comprises an inner liner portion and an outer insulation portion. The liner and insulation structure thus formed is configured so as to be received and held in place by the outer refrigerator cabinet. The structure and method of assembly disclosed in this patent are suitable for refrigerators in which the bottom wall or deck of the refrigerator cabinet is flat, because the bottom liner and insulating member is formed by folding a flat sheet of laminate. However, it is often necessary that the refrigerator deck be configured in an irregular fashion to accommodate components of the refrigeration system which are contained below the deck, and this requires that the bottom liner and insulation assume a similar irregular configuration. The above-mentioned Lindenschmidt patent does not provide for such liner configurations.

In a co-pending application of Robert Lindenschmidt, Ser. No. 602,762 filed Aug. 7, 1975, a technique is disclosed for folding a liner-insulation laminate so as to form the side and bottom walls of a refrigerator cabinet for a refrigerator in which the rear portion of the deck slopes upward. The method of forming a refrigerator liner and insulation structure disclosed in this application is not well suited for applications in which the deck assumes a more complex irregular shape.

SUMMARY OF THE INVENTION

The present invention comprehends an improved refrigeration apparatus liner and insulation structure wherein the base of the structure can be formed in any desired fashion to accommodate a complex, irregular cabinet deck configuration while the remaining liner and insulation can be formed by selectively cutting and folding a laminate. In one embodiment, the irregular base is provided with upstanding walls about at least a portion of its periphery. These walls define an upward facing abutment surface which supports the upright side walls of the liner-insulation structure by engaging a lower edge portion of the side walls. The upright walls are formed from a laminate stock having an inner sheet liner portion and an outer insulation portion.

In the preferred embodiment, the sheet liner portion is continuous, being folded at the rear vertical corners of the upright wall with the insulation being parted outwardly thereof. After being folded, the lower edge portion of the laminate defines a downward facing surface which rests upon the upward facing abutment surface defined by the base sidewalls. The width of the downward facing laminate edge and the inherent strength of the laminate itself are such that no additional supporting means for the cabinet liner-insulation structure are required. The liner-insulation structure fits snuggly into the exterior cabinet, the base and side walls being held in registry in this manner. As long as the base is provided with upstanding side walls which define a surface complementary to that defined by the lower edge of the laminate side walls, the remaining portion of the base can be formed to whatever irregular configuration the refrigerator deck requires.

Thus, the general structure and method of assembly disclosed in the above-mentioned Lindenschmidt U.S. Pat. No. 3,910,658, can be applied to a refrigeration apparatus having an irregular inner surface to which the laminate could not easily be folded. Accordingly, a wide variety of refrigeration apparatus models can be manufactured by a simple, economical process which includes the steps of (1) forming, by any convenient manufacturing process, the irregular base member for each model, (2) cutting and folding liner-insulation laminate stock to form the remaining portion of the structure and (3) inserting the base and laminate members into the exterior cabinet such that the laminate side walls rest on upstanding portions of the base.

BRIEF DESCRIPTION OF THE DRAWING

Other features and advantages of the invention will be apparent from the following description taken in connection with the accompanying drawings wherein:

FIG. 1 is a perspective view of a refrigeration apparatus provided with a wall structure embodying the invention;

FIG. 2 is a cross section of a laminate stock adapted for use in the wall structure of the invention;

FIG. 2*a* is a fragmentary cross section of an alternative laminate stock structure;

FIG. 3 is an exploded view illustrating the arrangement of the liner-insulation structure for use with the outer shell of the refrigeration apparatus in defining the enclosure cabinet of the refrigeration apparatus;

FIG. 4 is a fragmentary vertical section taken along lines 4—4 of FIG. 3 illustrating the abutment means of the wall structure;

DESCRIPTION OF THE PREFERRED EMBODIMENTS

Figure 5:
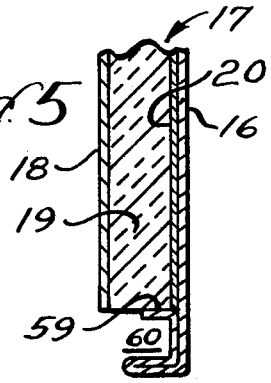
FIG. 5 is a cross section illustrating how the wall structure is received by the exterior cabinet.

In the exemplary embodiment of the invention as disclosed in FIGS. 1–5 of the drawing, a refrigeration apparatus generally designated 10 is shown to comprise a dual compartment refrigerator-freezer apparatus having a cabinet enclosure defining a freezer space 12 and an above-freezing space 13 selectively closed by doors 14 and 15. The cabinet enclosure includes an outer shell 16 which is conventionally formed of metal and an inner insulating wall structure generally designated 17 adapted to be readily fitted into the outer shell.

The insulating wall structure 17 may be formed from a laminate stock comprising a continuously formed laminate of an inner sheet liner 18 and an outer insulation 19. A vapor barrier 20 may be wrapped around the insulation 19, as shown in FIG. 2, as desired. By way of example, the liner 18 may be made of sheet metal or plastic, the insulation 19 may be polyurethane foam and the vapor barrier may be thin aluminum foil with kraft paper backing.

The laminate stock may be utilized in forming a lower U-shaped upright wall generally designated 21 of insulating wall structure 17, as shown in FIG. 3. Thus, as shown therein, a panel generally designated 22 cut from the continuously formed laminate may be provided with fold lines 23 and 24 extending between a lower edge 25 and an upper edge 26 thereof. The insulation may be parted adjacent the fold lines 23 and 24 so that, upon folding of the panel 23 into the U-shaped configuration shown in full lines in FIG. 3, voids 27 are defined outwardly of the fold lines.

The bottom of the refrigerator space 13 is defined by a base 28 which may be formed to have an irregular configuration determined by the configuration of the cabinet deck 50 upon which the base 28 rests. Cabinet deck 50 is conventional structural part of the refrigeration apparatus cabinet, formed of rigid sheet metal and extending generally horizontally between the lower portions of the exterior cabinet back and side walls. The deck is spot welded to the inner surfaces of the back and side walls, as illustrated at 57 in FIG. 5. The location of the deck is illustrated by dotted line 58 in FIG. 1.

Although the base 28 may assume various irregular configurations, by way of example it is illustrated in FIG. 3 as having a horizontal bottom wall portion 29, a beveled rear portion 30 and upstanding sidewall portions 31 and 32. The upper surface 33 defined by the sidewall portions 31, 32 and rear wall portion 34 of the base defines an upwardly facing abutment surface for supporting the lower edge portion 35 of the lower U-shaped wall 21. Base 28 may be formed by blow molding to include an outer wall 36, with insulation 37 foamed-in-place therein, as illustrated in FIG. 4. By the use of blow molding, the base 28 can be easily formed to whatever irregular configuration the refrigerator deck requires, including many configurations to which a flat sheet of liner-insulation laminate could not readily be folded.

Having formed the insulating wall structure 17 and base 28, the refrigeration apparatus enclosure is then assembled by inserting base 28 and the insulating wall structure 17 into the exterior cabinet 16 which has been previously formed by conventional manufacturing means. As illustrated generally in FIG. 3, and more particularly set forth in the aforementioned Lindenschmidt U.S. Pat. No. 3,910,658, other portions of the interior wall structure may be formed from a liner-insulation laminate. Such portions may include a liner and insulating wall for a freezing compartment to be located above the compartment defined by the wall structure 21. The wall structure 17 and base 28 are of such a size that they are received snuggly by the exterior cabinet 16 and held in registration thereby. As illustrated in FIG. 5, the insulated wall structure 17 extends forward such that the insulation portion 19 contacts a rearward facing portion 59 of the cabinet front flange 60. A breaker strip (not shown) covers the area between the cabinet front flange 60 and the inner liner 18, as is conventional. Accordingly, no additional supporting or securing means are required to hold the liner and insulation structure for the refrigeration apparatus in place. As can be seen in FIG. 4, the lower edge 35 of the insulating wall structure 21 rests directly on the upper support surface 33 defined by the side wall portions 31, 32 and 34 of base 28.

Thus, a complex formed base structure 28 is provided, and is adapted to have mating abutment with the relatively simply formed upright U-shaped wall 21 by provision of the rectilinear portions of the abutment surface 33 arrnaged in a complementary U-shaped configuration.

Figure 6:
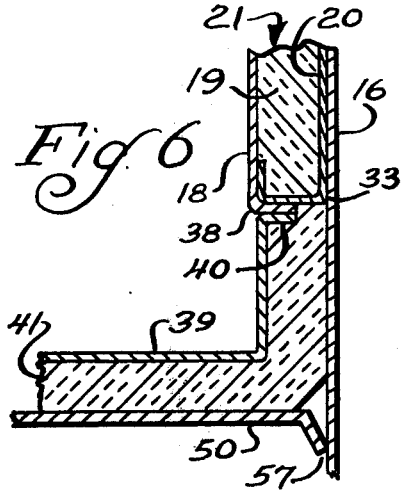
FIG. 6 is a fragmentary vertical section of a modified form of abutment means of the wall structure.

The details of the abutment between the upright side wall 21 and base 28 can be varied to accommodate different configurations of the abutment surface provided by base 28. For example, it may be desired to form base 28 from a sheet of plastic liner material which is placed in the bottom of the exterior cabinet 16 after a piece of previously formed insulation has been placed on the cabinet deck. As illustrated in FIGS. 2*a* and 6, for such an application the sheet liner portion 18 of the upright wall 21 may be provided with a lower outturned flange portion 38 which extends partially toward the outer cabinet wall 16. The inner surface of the base 28 may be defined by a sheet liner 39 having an outturned upper flange 40 extending along the upper surface of each of walls 31, 32 and 34 to provide a portion of the abutment surface generally designated 33. A slab of insulation 41, which may be molded urethane, is placed on the cabinet deck 50 and the liner 39 is then placed on the insulation 41. The flange 40 may or may not extend outward all the way to cabinet wall 16. However, to prevent direct thermal transfer between the liner and cabinet exterior, it is desirable that both flanges 38 and 40 terminate short of wall 16. The flanges 38 and 40 cooperatively support the insulated wall structure 17, as illustrated in FIG. 6.

Figure 7:
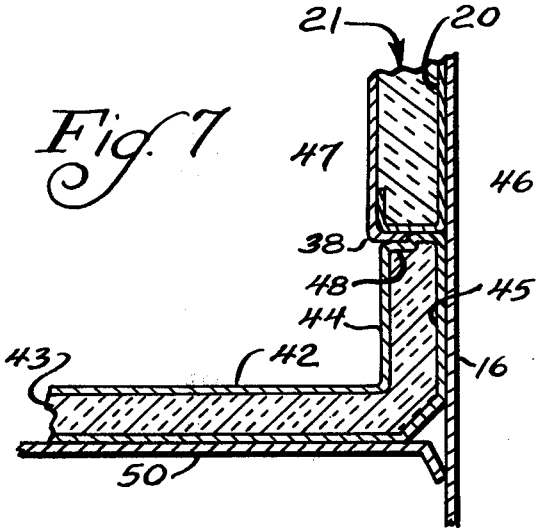
FIG. 7 is a fragmentary vertical section of a further modified form of abutment means embodying the invention.

In another alternative embodiment, where the base is formed of a blow-molded outer wall, such as outer wall 42 illustrated in FIG. 7, with the insulation 43 being foamed-in-place therein, the inner sheet liner portion 44 may be joined to an outer wall portion 45 by an interconnecting horizontal portion 46 which upwardly defines the abutment surface 47. The connecting portion 46 may be provided with a recess 48 opening inwardly toward sheet liner portion 44 to receive the outturned flange 38 of the upright wall 21.

Figure 8:
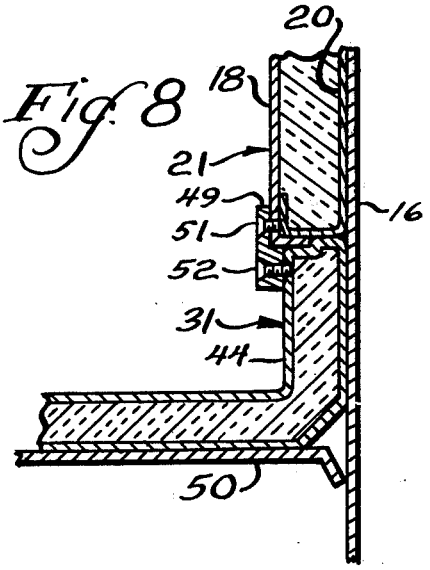
FIG. 8 is a fragmentary vertical section of a still further modified form of abutment means.

As shown in FIG. 8, the abutment between the upright wall 21 and the sidewall, such as sidewall 31 of base 28, may be covered by a track 49, such as for movably supporting a shelf bracket, or the like. The track may be secured to the sheet liner 18 of the upright wall by suitable screws 51 and to the sheet liner 44 of the base by suitable screws 52. The track may further serve to secure the walls in abutted relationship, as illustrated in FIG. 8. Such a track may, of course, be used with the embodiments shown in FIGS. 4 and 6 as well.

Figure 9:
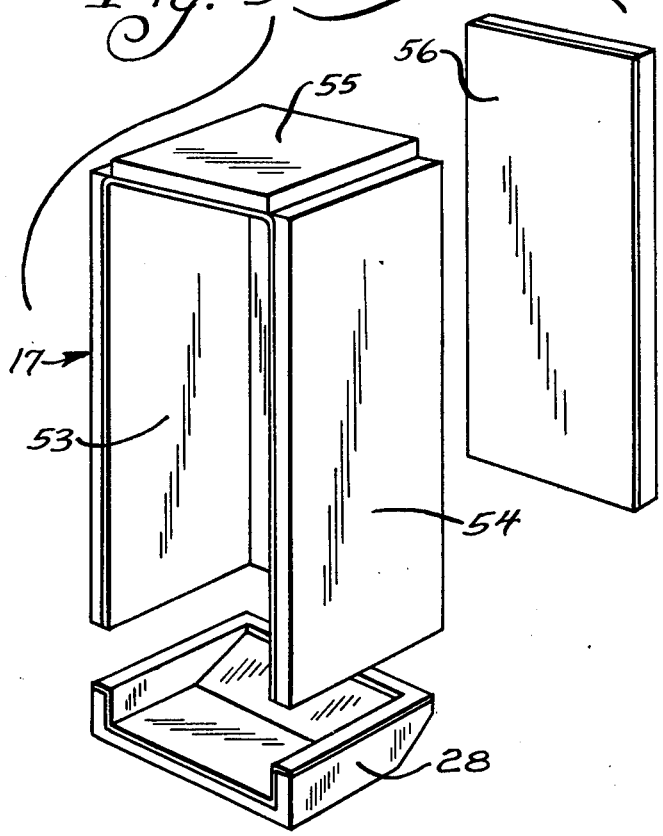
FIG. 9 is an exploded view illustrating an alternative arrangement of the liner-insulation structure.

It may be desirable to form the insulating structure generally designated 17 by folding the liner-insulation laminate to form two side walls and a top wall of the liner rather than folding the laminate to form three side walls. Such a configuration would be particularly suited for use in upright freezers which require long, continuous upright side walls which may have a height greater than the width of the liner-insulation laminate stock used. As illustrated in FIG. 9, the laminate may be folded to form sides 53 and 54 and top 55 of the refrigerated enclosure. A back panel 56 may be cut from the laminate and placed in the refrigerator outer cabinet prior to the insertion of the folded top and side walls. Base 28 may again take whatever irregular configuration is required by the cabinet deck and may be formed in any desired manner as previously described. The base is placed within the exterior cabinet prior to the installation of the insulated back and side walls. The refrigeration apparatus structure thus provided has the versatility of the previously described structure, in that a folded laminate liner and insulation can be used regardless of an irregular deck configuration.

Thus, the invention comprehends an improved cabinet construction wherein a preformed base is provided with an upper abutment surface upon which rests the lower edge of an upright wall cooperatively defining with the base a forwardly opening refrigerated space. The liner and insulation portion of the upright wall are supported by the base, which rests on the deck portion of the refrigeration apparatus cabinet. The base may be formed in any suitable manner to accommodate the configuration of the cabinet deck, permitting the use of the low cost laminate panels in the remainder of the cabinet construction.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having an exterior cabinet, an improved liner and insulation structure comprising: a base having a formed bottom, and side and rear portions defining a generally upward facing abutment surface; and an upright wall structure formed of a folded laminate of an inner sheet-like liner and an outer insulation, said wall structure having a lower edge portion resting on said base abutment surface to define therewith within said cabinet at least a portion of the interior refrigerated space of said refrigeration apparatus.

2. The improved liner and insulation structure of claim 1 wherein said base side and rear portions comprise upstanding walls.

3. The improved liner and insulation structure of claim 1 wherein said exterior cabinet includes a generally horizontal deck and said base is supported by said deck.

4. The improved liner and insulation structure of claim 3 wherein said base is formed so as to have substantially the same shape as said deck.

5. The improved liner and insulation structure of claim 1 wherein said base includes an inner sheet liner portion and an insulating portion below said sheet liner portion.

6. The improved liner and insulation structure of claim 1 wherein said upright wall structure comprises a U-shaped downwardly opening wall element cooperating with the base to define a forwardly opening space above said base.

7. The improved liner and insulation structure of claim 1 wherein said upright wall structure comprises a unitary U-shaped wall element formed by folding said laminate so as to define three interior liner wall surfaces.

8. The improved liner and insulation structure of claim 1 wherein said laminate includes a vapor barrier which substantially covers said outer insulation.

9. The improved liner and insulation structure of claim 8 wherein said insulation extends beyond said sheet-like liner and has a substantially flat edge which defines said wall structure lower edge portion.

10. The improved liner and insulation structure of claim 1 wherein said liner base and said wall structure are held in registry by said exterior cabinet.

11. The refrigeration apparatus liner and insulation structure of claim 1 wherein said abutment surface defines an inner recess, and said sheet liner includes an outturned edge received in said recess, said recess extending approximately half the thickness of said abutment surface.

12. A refrigeration apparatus liner and insulation comprising: a base having a formed bottom wall, and an upstanding wall defining an upper abutment surface; and an upright wall formed of a laminate of an inner sheet liner and an outer insulation, said upright wall having a lower edge portion resting on said base wall abutment surface, at least one of said upstanding and upright walls having an outturned inner wall portion extending subjacent the insulation of said upright wall at said abutment surface to provide at least a partial bottom support for said insulation.

13. The refrigeration liner and insulation structure of claim 12 wherein said base upstanding wall includes an inner sheet liner defining said outturned wall portion.

14. The refrigeration apparatus liner and insulation structure of claim 12 wherein said upright wall sheet liner defines said outturned wall portion.

15. The refrigeration apparatus liner and insulation structure of claim 12 wherein said base comprises a formed laminate having an inner sheet liner and an outer insulation.

16. The refrigeration apparatus liner and insulation structure of claim 12 wherein an elongated track element extends along the abutment between said upstanding and upright walls.

* * * * *